United States Patent [19]

Torii et al.

[11] 3,964,068

[45] June 15, 1976

[54] WINDOW ANTENNA AND DEFROSTER FOR USE IN MOTOR VEHICLE

[76] Inventors: Taketsugu Torii, 1827-2, Fujiyama, Shiroyama-cho, Kasugai, Aichi; Minoru Nishio, 44, Kawara, Tenpaku-cho, Okazaki, Aichi, both of Japan

[22] Filed: Jan. 6, 1975

[21] Appl. No.: 538,901

[30] Foreign Application Priority Data

Jan. 14, 1974 Japan ..... 49-7432[U]

[52] U.S. Cl. ..... 343/704; 343/713

[51] Int. Cl.[2] ..... H01Q 1/32

[58] Field of Search ..... 343/711, 712, 713, 704

[56] References Cited

UNITED STATES PATENTS

| | | | |
|---|---|---|---|
| 2,608,657 | 8/1952 | Spirt et al. | 343/820 |
| 3,196,443 | 7/1965 | Martin | 343/821 |
| 3,484,584 | 12/1969 | Shaw | 343/711 |
| 3,771,159 | 11/1973 | Kawacuchi et al. | 343/713 |

*Primary Examiner*—Eli Lieberman

*Attorney, Agent, or Firm*—Lane, Aitken, Dunner & Ziems

[57] ABSTRACT

A radio antenna device having a gain compensating circuit and an antenna wire rigidly secured to the rear window of a motor vehicle, coupled with a moisture preventive heat wire. The antenna wire is secured to the rear window of the motor vehicle so as to reduce the noise in the received radio waves, which results from electrical noise from the vehicle engine, electric generator and electric motor. The rear window also serves as a convenient antenna space. A gain compensating circuit is provided for compensating for the reduction in the level of the received radio wave, which reduction is caused by the shielding action of the moisture preventive heat wire secured to the rear window and the portion of the body of the vehicle, which extends along the periphery of a rear window.

3 Claims, 2 Drawing Figures

WINDOW ANTENNA AND DEFROSTER FOR USE IN MOTOR VEHICLE

SUMMARY OF THE INVENTION

This invention relates to a radio antenna device for a motor vehicle, and more particularly to a radio antenna provided on the rear window of a motor vehicle.

Hitherto, an antenna of a pole type has found its wide use in a motor vehicle, suffering a disadvantage of the need to provide a space for allowing the extension of an antenna, resulting in inconvenience in its practical use. To overcome such a disadvantage, there has been proposed an attempt to provide an antenna on the front portion of a motor vehicle. However, this is not a good solution to the aforesaid problem, because of electrical noise being emitted from the vehicle engine, electric generator and other electric circuits.

This invention is directed to avoiding the aforesaid disadvantages by providing a radio antenna device for use in a motor vehicle, which eliminates the need for providing an antenna space and has less noise reception and is substantially high in gain.

According to the present invention, there is provided a radio antenna device comprising an antenna wire rigidly secured to the rear window of a motor vehicle in a similar manner to that used for a moisture preventive heat wire, coupled with a gain compensating circuit connected to the aforesaid antenna wire.

This arrangement minimizes the noise in received radio waves, because the antenna device is secured to the rear window which is remote from the vehicle engine and the generator located in the front portion of the vehicle as well as other electric circuits (of which there are more in the front portion of the vehicle than in the rear). However, the function of the antenna device to receive radio waves is somewhat hindered, because the antenna is electrically shielded by a moisture preventive heat wire and the body of the vehicle, which extends along the periphery of the rear window. To overcome this shortcoming, the present invention provides a gain compensating circuit at the point where the antenna connects to a feeder to thereby compensate for the gain reduction in the connection from the antenna to the radio equipment with the result that a high gain is achieved comparable to that of a pole type antenna.

DETAILED DESCRIPTION OF THE PREFERRED EMBODIMENTS

Figure 1:
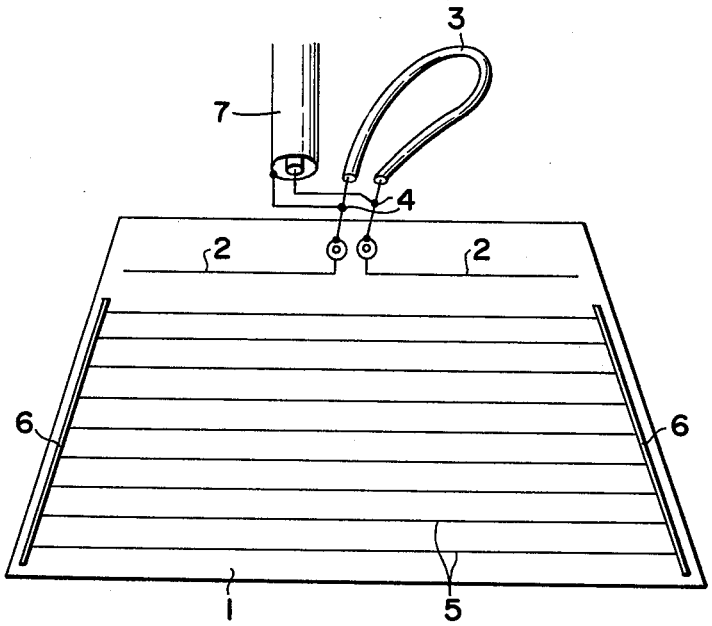
FIG. 1 is a plan view of an antenna device embodying the present invention.

FIG. 1 shows one of the embodiments of the present invention, using a "U" shaped tube line as a gain compensating circuit. Reference No. 1 designates a rear window of an automotive vehicle having provided thereon a dipole antenna 2, a moisture preventive heating wire 5, and main lines 6 for supplying an electric current to the moisture preventive heating wires 6. A coaxial feeder 7 connected to radio equipment is connected via the connecting wires 4 to the dipole antenna. The dipole antenna 2 comprises two wires positioned on the rear window 1 as shown in FIG. 1. The moisture preventive wires 5, main lines 6 and the wires of the antenna 2 are prepared on the window by using coating and baking techniques and electrically conductive materials. Alternatively, they may be prepared by using metal evaporating or laminating technique. A U-tube line 3 is connected across the connecting wires 4. The U-tube is preferably embedded in the roof of the automotive vehicle.

The U-tube line 3 is simply a U-shaped electrical conductor connected across the connecting wires 4 and as a gain compensating circuit is designed to have a length of one-half wave length of the radio wave to be received. In this respect, only the wave length of the FM signal is of concern, because there is no problem in receiving AM, because of its relatively high radio-wave receiving gain.

The frequency of FM, in Japan, covers a range from 76 to 90 MHz and is from 88 to 108 MHz in the United States. The line 3 is dimensioned to half the wave length of the average frequency of 83 MHz in Japan and 98 MHz in the United States. This setting should not necessarily be accurate nor is there a need to select the specific length of a U-tube line for each station.

Figure 2:
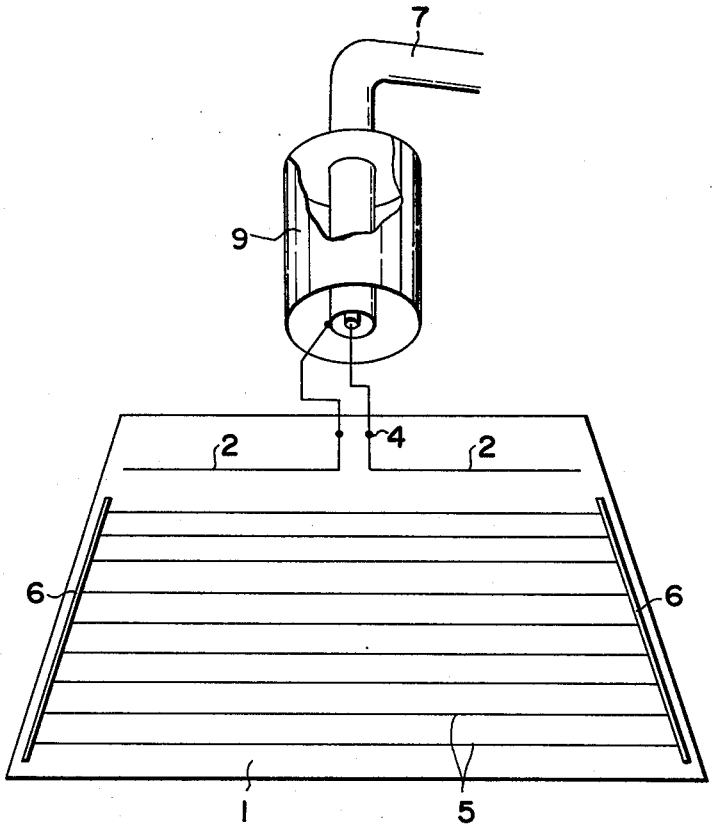
FIG. 2 is a plan view of another antenna embodying the present invention, showing a wave trap circuit in an enlarged view as a gain compensating circuit for use in the present invention.

Referring to FIG. 2, there is shown a wave trap circuit *a* as a gain compensating circuit. The wave trap circuit 3 is a conductor of a length of one-fourth of the wave length of received FM and connects to the external conductor of a coaxial feeder 7. The reference numerals used herein are in common with those used in FIG. 1. Alternatively, an LC circuit may be used in place of the gain compensating circuit.

The potential at the external conductor of a coaxial feedline is zero when an internal conductor is at a certain potential, since the external conductor of the coaxial feed is grounded. In contrast thereto, in parallel lines, one line will assume negative potential when the other assumes a positive potential at the same level and vice versa. As a result, when parallel lines are connected to the coaxial feeder, an unbalanced electric current will flow through the parallel lines under the influence of the coaxial line. In other words, an electric current flowing through the inner line of the coaxial line needs to be converted at the connecting point into balanced current, flowing through each of the parallel two lines. However, with no compensating circuit an electric current flowing through the inner conductor of the coaxial line will flow intact through the other line of the parallel lines, resulting in an unbalanced electric current flowing through the parallel two lines. Such an unbalanced current emits an electric wave to atmosphere, causing matching loss. In the system of the present invention, a gain compensating circuit is connected to the connecting point of an antenna to the feeder, so that gain loss from the balanced type antenna is reduced, while noise is minimized by providing the antenna in the rear portion of the motor vehicle. In the case of the use of a U-tube line, the phase of the signal wave is reversed at the connecting point of the U-tube line to the parallel two lines, so that the balance is maintained and the reduction in gain that would otherwise occur is avoided.

As is apparent from the foregoing description, an antenna is provided on the rear window of a motor vehicle and a gain compensating circuit is connected to the connecting point of the antenna to the feeder, so that the needed space for mounting an antenna is eliminated and the disturbance due to noise is minimized, while reduction in gain may be prevented due to the provision of a gain compensating circuit which compensates for the attenuation of FM waves due to shielding actions of a moisture preventive heating wire and the like.

We claim:

1. A window antenna device for use in a motor vehicle, comprising:

a balanced type antenna secured to the rear window of said vehicle, said window having a moisture preventive heating wire;

a coaxial feeder connected to said antenna;

a gain compensating circuit connected to connections between said antenna and said feeder to balance the current flow in said antenna, said circuit being adapted to function at an average FM frequency between the lowest frequency and the highest frequency to which FM radio equipment connected to said coaxial feeder can be tuned, and said circuit being embedded in the roof of the motor vehicle.

2. A window antenna device for use in a motor vehicle as set forth in claim 1, wherein said gain compensating circuit comprises a U-tube line the length of which is one half of wave length of said average FM frequency.

3. A window antenna device for use in a motor vehicle as set forth in claim 1, wherein said gain compensating circuit comprises a wave trap circuit the length of which is one fourth of wave length of said average FM frequency.

* * * * *